United States Patent [19]

Crawley

[11] Patent Number: 4,836,542

[45] Date of Patent: Jun. 6, 1989

[54] FOOTBALL KICKING PRACTICE DEVICE

[76] Inventor: Matthew J. Crawley, 63 Montclair Ave., Montclair, N.J. 07042

[21] Appl. No.: 200,134

[22] Filed: May 31, 1988

[51] Int. Cl.[4] ..... A63B 67/00

[52] U.S. Cl. ..... 273/55 B; 273/181 F; 273/400; 273/407

[58] Field of Search ..... 273/55 B, 26 A, 29 A, 273/181 F, 181 U, 181 A, 398, 410, 396, 400, 401, 407

[56] References Cited

U.S. PATENT DOCUMENTS

| | | | |
|---|---|---|---|
| 920,907 | 5/1909 | Bolton | 273/181 F |
| 1,430,280 | 9/1922 | Bolton | 273/181 F |
| 2,125,679 | 8/1938 | Longstreet | 273/55 B |
| 3,758,116 | 9/1973 | Pieronek | 273/400 |
| 3,820,787 | 6/1974 | Heinbigner | 273/55 B |
| 3,822,883 | 9/1974 | DeVos | 273/181 F |
| 3,836,147 | 9/1974 | Shapiro | 273/55 B |
| 3,856,301 | 12/1974 | Davidson | 273/181 F |
| 4,068,846 | 1/1978 | Forrest | 273/181 F |
| 4,116,446 | 9/1978 | Thompson | 273/181 F |
| 4,437,661 | 3/1984 | Chavez | 273/55 B |
| 4,762,319 | 8/1988 | Krumholz | 273/55 B |
| 4,786,053 | 11/1988 | Barnes | 273/400 |

*Primary Examiner*—Richard C. Pinkham
*Assistant Examiner*—T. Brown
*Attorney, Agent, or Firm*—Howard E. Thompson, Jr.

[57] ABSTRACT

A football kicking practice device comprising similar frame parts joined by a front top transverse member to be disposed in parallel vertical orientation, with such frame parts including horizontal rearwardly extending portions joining vertical downwardly extending portions, in turn joining downwardly inclined portions extending to a point of vertical alignment with the top transverse member, and further joining downwardly extending vertical portions terminating with structure at the lower ends for supporting the frame in vertical orientation, and a large rectangular net with a peripheral sleeve along three sides thereof slidably engagable with the frame structure, whereby the net as assembled to the frame hangs in a manner to provide a forwardly and downwardly bulged upper portion, blending with a lower hanging and forwardly inclined trough portion. For permanent installation the similar frame parts can be of unitary structure with the lower vertical frame portions elongated for mounting in the ground; but a preferred adaptation involves a multi-component frame structure fashioned from plastic pipe and fittings and including components providing a support base, the integrity of the assemblage being assured by having the plastic fittings permanently secured to ends of the front-to-rear extending frame members, and having vertical and transverse frame members detachably secured thereto.

10 Claims, 2 Drawing Sheets

FOOTBALL KICKING PRACTICE DEVICE

This invention relates to a football kicking practice device which incorporates a unique pipe frame structure to support a flexible net in a manner to provide both effective shock absorbing action when intercepting a kicked ball, and convenient ball return. In a preferred adaptation of the invention the frame structure is made up of plastic pipe sections and plastic elbows, conventional to the plumbing industry, which are partially preassembled in a manner to enable quick assembly and disassembly of the frame, and compact storage in a duffle bag of moderate size during periods of non-use and transport from place to place.

BACKGROUND OF THE INVENTION

It has long been the practice in training of football players specializing in punting and place-kicking the football to supplement open field training with localized training using ball intercepting means to keep the practice ball within the immediate vicinity of the practicing individual. Such intercepting means generally takes the form of a relatively large permanently installed frame supporting a flexible net for intercepting the flight of a kicked ball. Such structures are generally quite large and, while appropriate for established football training areas, restrict the individual to practice at the location of such permanent installation.

There is a need for providing greater opportunity for football kicking specialists to devote training time at home or at other locations away from the established practice area. It is meeting of this need which induced applicant, at the time active in college football as a punting specialist, to construct for his home practice and training the device of the present invention; and to applicant's knowledge nothing of a comparable nature has previously been devised.

A preliminary search in the Patent Office failed to develop any prior art considered to have any direct or anticipatory bearing on the present invention. The closest prior art found in this search is U.S. Pat. No. 3,820,787 issued June 28, 1974 to Leonard F. Heinbigner for Football Practice Target and U.S. Pat. No. 4,437,661 issued March 20, 1984 to John P. Chavez for Football Kicking Trainer Toy. Both of these devices incorporate a small, generally rectangular target frame peripherally supporting a mesh bag which hangs to the rear of the target frame. While these devices can effectively intercept a properly kicked ball they have the disadvantage of being too small to intercept a poorly kicked ball; and even when the ball is intercepted it is inherently difficult and awkward to retrieve the intercepted ball from the hanging bag net configuration behind the target frame. These prior patents have no direct bearing on the subject matter of the present invention.

THE INVENTION

In accordance with the present invention, a football kicking practice device is provided comprising similar frame parts joined by a front top transverse member to be disposed in parallel vertical orientation, with such frame parts including horizontal rearwardly extending portions joining vertical downwardly extending portions, in turn joining downwardly inclined portions extending to a point of vertical alignment with the top transverse member, and further joining downwardly extending vertical portions terminating with means at the lower ends for supporting the frame in vertical orientation, and a large rectangular net with a peripheral sleeve along three sides thereof slidably engagable with the frame structure; whereby the net as assembled to the frame hangs in a manner to provide a forwardly and downwardly bulged upper portion, blending with a lower hanging and forwardly inclined trough portion, such net configuration providing a unique shock absorbing action as the net intercepts a kicked football.

For permanent installation the similar frame parts can be of unitary structure with the lower vertical frame portions elongated for mounting in the ground; but a preferred adaptation involves a multi-component frame structure fashioned from plastic pipe and fittings and including components providing a support base, the integrity of the assemblage being assured by having the plastic fittings permanently secured to ends of the front-to-rear extending frame members, and having vertical and transverse frame members detachably secured thereto, whereby the device can be readily disassembled for compact storage and transport in a duffle bag of moderate size.

The device of the present invention can be made in various sizes, but an appropriate size combining versatility in use and compactness of storage and transport of the preferred adaptation, is a frame structure about 7½' high and 3½' wide and having a front-to-rear base dimension of about 3½'. As a permanent installation, however, it could be desirable to slightly increase the height and width; and the base structure would of course be replaced by downward extensions for embedding in the ground or appropriate ground sockets.

The frame structure for a permanent installation can have side frame parts fashioned from unitary pipe members deformed to provide the configuration of horizontal, vertical and inclined portions above described with the top transverse member being detachably coupled with the said frame parts to facilitate assembly of the net to the frame.

In the preferred, knocked-down adaptation of the invention all frame parts comprise plastic piping and plastic fittings (90° elbows and 45° elbows) which are conventional in the plumbing industry, such piping and fittings suitably being of the 1½" or 2" size. While the same size piping and fixtures can be used throughout the frame it is considered desirable to employ the 2" pipe and fittings in the lower portion of the device and 1½" pipe and fittings in the upper portion. In such event the 45° elbows at the lower ends of the inclined frame portions will be of the 2" size with bushings permanently secured in their upper ends to receive inclined frame portions of the 1½" size.

The plastic elbows, as conventional in the plumbing industry, have slightly tapered socket walls permitting plastic piping to be firmly supported therein by application of axial pressure. This physical wedging action provides an extremely strong joint when cement is applied to the parts before assembly; but it is also of sufficiently tight engagement to maintain structural integrity of assembled parts without cementing the joint. Parts thus assembled by axial pressure engagement of a pipe section with an elbow socket can readily be disengaged by applying a sharp trans-axial blow to the pipe section a foot or so from the associated elbow.

In order to facilitate assemblage of the frame components as a structure having the configuration above described it is desirable that some of the pipe sections and elbows be cemented together with the angularity of the elbows accurately predetermined. A preferred manner to provide such sub-assemblies is to permanently mount the appropriate elbows with front-to-rear extending members of the fame, namely the top and bottom horizontal frame portions and the forwardly inclined frame portions. These sub-assemblies can then be easily assembled with the straight pipe sections forming the vertical frame portions and transverse members by pressure engagement of the pipe sections with the prealigned elbow sockets.

The netting employed is conventional weather-proof nylon of the type used in many athletic areas to restrain movement of balls or their game pieces. The main body of the net is suitably of 1" to 1½" mesh and is provided on three sides with a sleeve, approximately 6" wide as flattened, of a somewhat finer texture, suitably ¼" to ½" mesh.

For a frame of the size described the net will have an overall dimension, including sleeves, of approximately 8 feet in width and 9 feet to 12 feet in length. The sleeve will extend along one 8 foot dimension and both longer dimensions of the net structure and should include cuts in the 8' sleeve portion in alignment with the juncture of the side sleeves and net body to facilitate assemblage of the net structure to the frame.

With a frame of the size described a net of 9' length will, when fully extended reach to the lower ends of the inclined frame parts and dispose the hanging portion of the net there-between close to the ground. Such an assembly is ideally suited for punting practice and quite appropriate for placekicking practice. This type assemblage could, however, fail to intercept a place-kick which had been badly topped. Accordingly, when the device is intended primarily for place-kick practice, it is desirable to use a net of 12' length so that the sleeve engagement with the frame will extend substantially to ground level.

The net is easily assembled to the frame structure with the top transverse member removed by first sliding the side sleeves onto the frame structure, then feeding the 8' sleeve section onto the transverse member while compressing the sleeve to fit within the length of the transverse member, and then inserting the transverse member and mounted sleeve portion into pressure engagement with the aligned elbows of the frame. The compressed portion of the sleeve is then fed along portions of the frame until it has been fully extended. It should be noted in this connection that above mentioned compression of the sleeve portion presents no problem. The 8' sleeve section can, in fact, be sufficiently compressed to occupy half the length of the transverse member.

When the device is disassmbled to provide 12 pipe sections it will be apparent that using 2" pipe in the lower structure and 1½" pipe in the upper structure permits the upper vertical and transverse members to be telescopically disposed within the vertical and transverse lower members, thus reducing to 9 the number of elongated entities to be assembled for storage and transport. These can be accommodated in a duffle bag of moderate size having a length determined by the length of the sub-assemblage of inclined frame portions and 45° elbows. A duffle bag of such nature would have ample space to carry a folded net, as well as a practice football and other gear.

As supported on a frame having the horizontal, forwardly extending top loop, joining vertical sections and then forwardly inclined frame sections the net, in the rest position, assumes a characteristic position or configuration uniquely suited to its ball-intercepting purpose. The upper portion of the suspended net forms a large forwardly and downwarly extending bulge which blends, at the rear of the device, into a deep forwardly inclined trough. This net configuration provides an excellent shock absorbing effect when intercepting both punted and place-kicked footballs.

In thus intercepting kicked footballs the net is temporarily distorted to positions substantially above and/or to the rear of the frame structure; but it rapidly returns to its rest position permitting the earlier mentioned trough to deliver the intercepted ball conveniently at the front of the device.

In using this device a punter will generally kick the ball at a point about 6' from the front of the device, in which event the ball, as intercepted, will extend the net to a point substantially above the top of the device. For place-kick practice the ball would be supported 6' to 8' in front of the device; and the kicked ball, as intercepted, will extend the net to a point substantially beyond the back of the frame. In either event, the net, as it returns to its rest position, delivers the ball conveniently at the front of the device.

The football kicking specialist practicing with this device will quickly learn to judge the "quality" of his practice kicks by the manner in which the net is distortd, as it intercepts the kicked ball. Thus the knock-down nature of the preferred adaptation is of real advantage to the conscientious specialist as it permits him to readily carry the device from place to place for practice in his back-yard, an open field, or even in an enclosed space having a ceiling height in excess of about 10'. A particular advantage of this portability is that it permits the kicking specialist to take the device along to "away games" and have the benefit of last minute practice with familiar equipment.

The kicking practice device of the present invention will be more fully understood from a consideration of the accompanying drawing in which the various parts thereof have been identified by suitable reference characters in the several views and in which.

Figure 3:
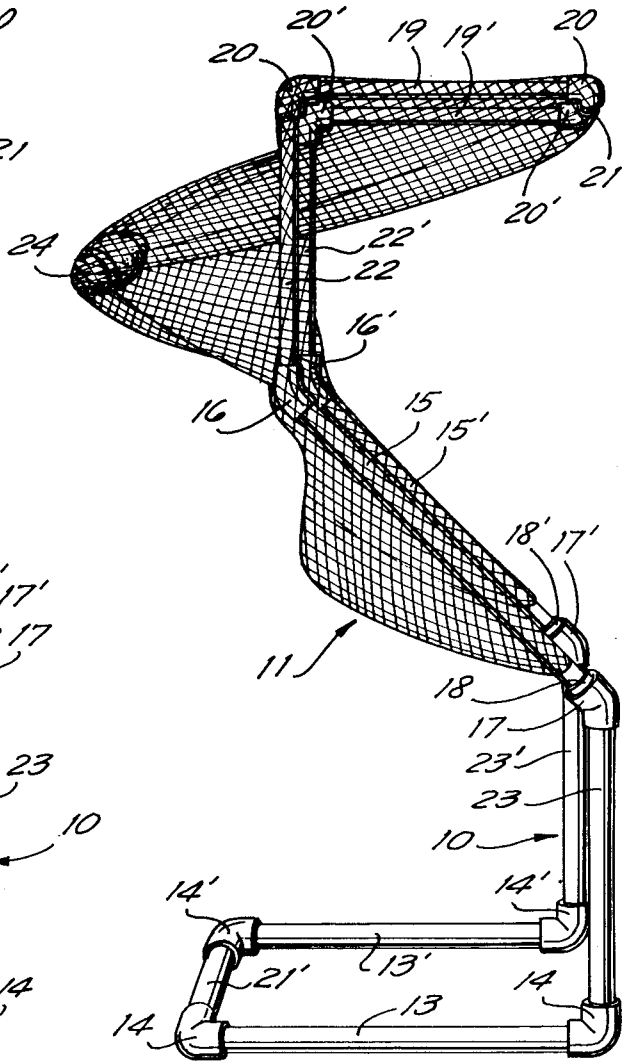
FIG. 3 is a view similiar to FIG. 1 showing a typical deformation of the net as intercepting a place-kicked football.

As shown in the drawing it will be seen that the kicking practice device comprises a frame of assembld pipe sections having a generally S-shaped contour as viewed from the side, which would be at the left of the user, with a net 11 having a sleeve 12 along three edges for engagement with and suspension from the frame 10.

The frame structure is fashioned from rigid plastic piping, suitably polyvinyl chloride, and plastic fittings of the 1½" and 2" sizes which are standard in the plumbing industry, with the members in the lower portion of the device being fashioned from 2" pipe and fittings and the members in the upper portion of the device being fashioned from 1½" pipe and fittings.

As is well known in the plumbing art the pipe receiving recesses of the elbow fittings have slightly tapered walls so that when cement is applied for assembling the parts the pipe and fitting can be forced into a tight wedging engagement which is then strengthened and bonded by the setting cement. It should be noted, however, that the wedging engagement can, itself, firmly secure the parts together, while permitting disengagement when desired by striking the pipe a sharp transaxial blow at a distance, i.e. 10–12 inches from the fitting.

In the frame 10 structural integrity, and proper alignment of the frame parts is attained by employing, as the six front to rear extending sections, preassemblags of pipe sections with elbow fittings permanently cemented to the ends thereof. These preassembled sections are then joined together by two transverse pipe sections and four vertical pipe sections by simple pressure engagement with the appropriate aligned fitting recesses of the preassembled parts.

Figure 2:
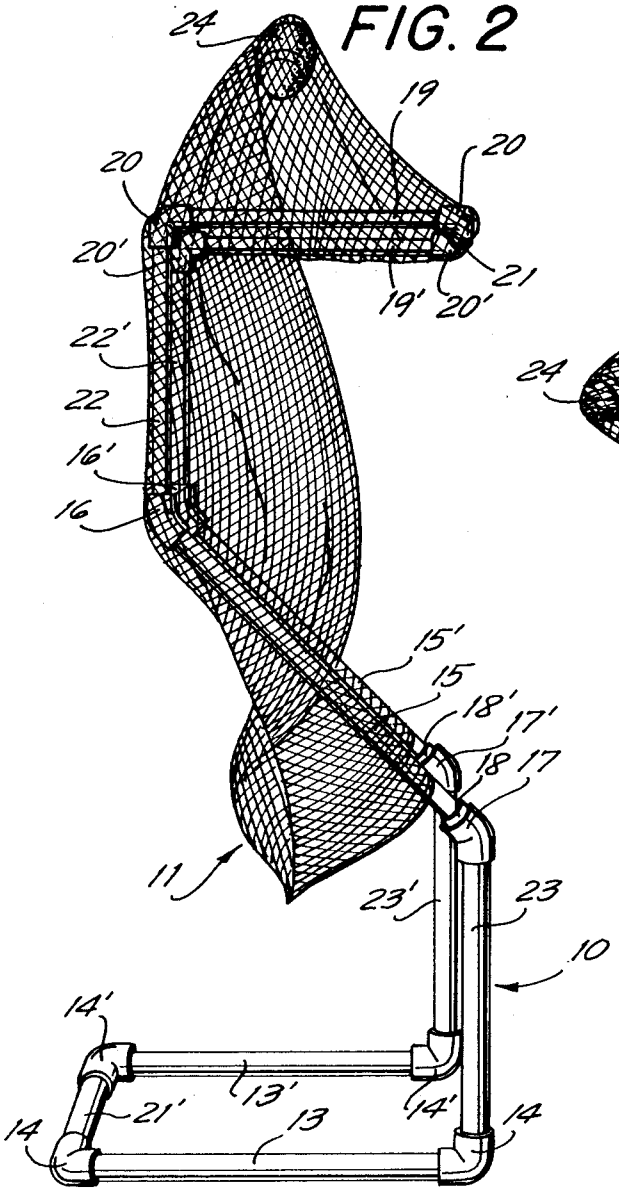
FIG. 2 is a view similiar to FIG. 1 showing a typical deformation of the net as intercepting a punted football.
Figure 1:
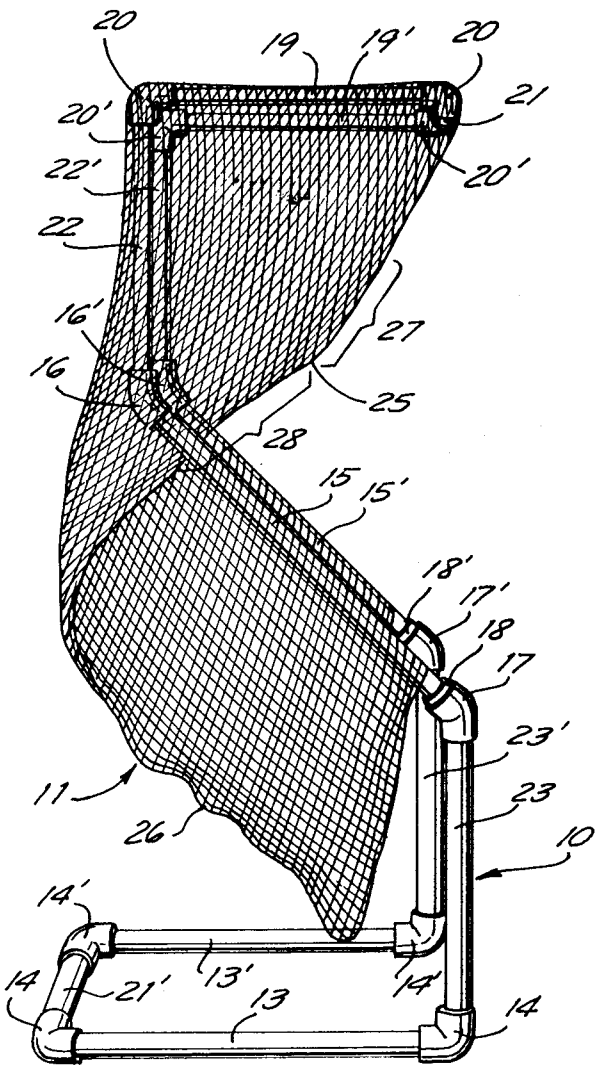
FIG. 1 is a view of the erected device, ready for use, as viewed from the side which would be to the left of the user.
Figure 5:
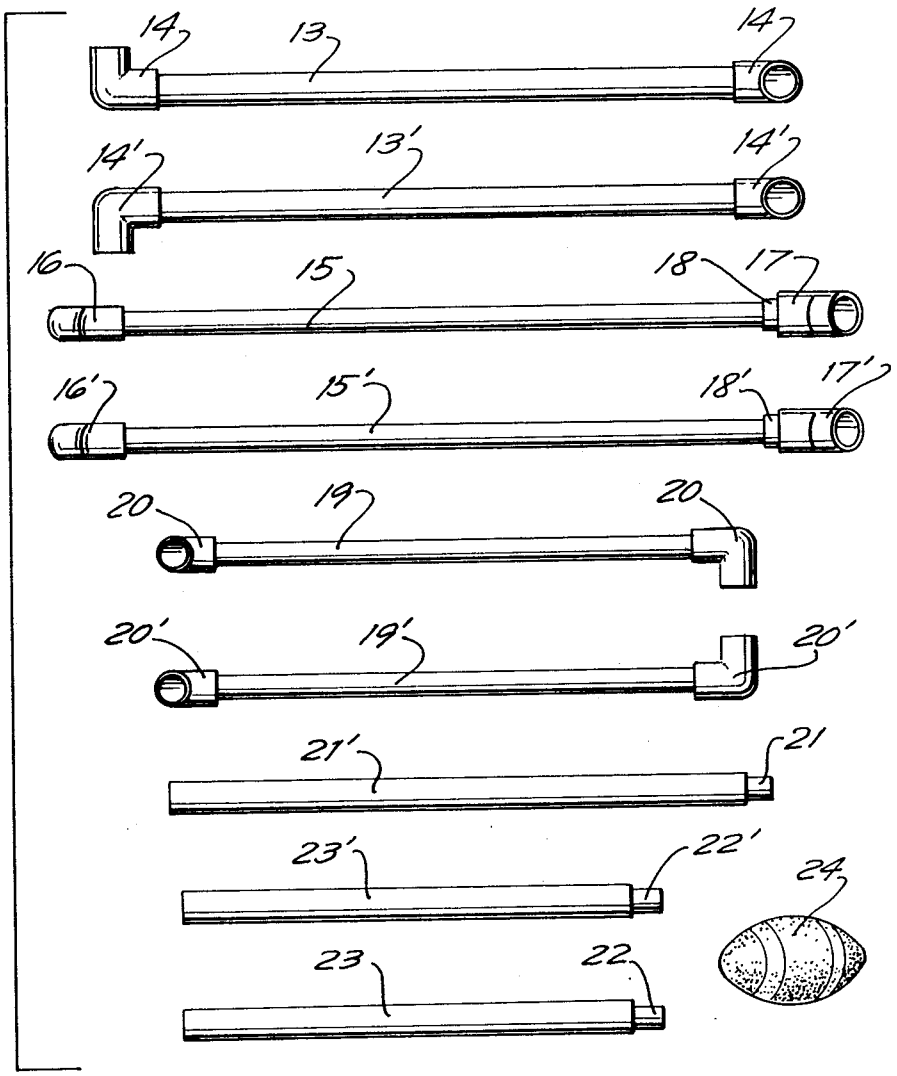
FIG. 5 is an expanded view of the disassembled frame parts of the device shown in FIG. 1 with a football shown to scale.

This manner of fabrication and assemblage will be fully apparent from a consideration of FIGS. 1 to 3 showing the full assemblage and FIG. 5 showing the disassembled components. In this Figure the components consist of:

Front-to-rear bottom section 13, 13', which are 2"×3' pipe sections with 90° elbows 14, 14'cemented thereto in the orientation shown.

Angular front-to-rear mid sections 15, 15', which are 1½"×3'5" pipe sections with 45° elbows secured to the ends thereof in the orientation shown, the elbows 16, 16' at the upper ends being 1½" fittings, and the elbows 17, 17' at the lower ends being 2" fittings with reducer bushings 18, 18' to accommodate the 1½" pipe sections.

Front-to-rear top sections 19, 19', which are 1½"×2'6" pipe sections with 90 elbows 20, 20' cemented thereto in the orientation shown.

Top and bottom transverse sections 21, 21' which are 1½"×3' and 2"×3' pipe sections respectively permitting telescopic storage as shown.

Top and bottom vertical sections 22, 22' and 23, 23' respectively, which are 1½"×2'4" and 2"×2'6" pipe sections permitting telescopeic storage as shown.

It is easy to visualiza that the components shown in FIG. 5 together with a folded net 11 and football 24 can readily be stored and transported in a compact duffel bag having a length dictated by the length of the angular mid-section 15, 15'.

The net 11 is fashioned from weatherproof nylon mesh suitably 1" mesh in the body portion 11' and smaller ¼" to ½" mesh in the sleeve portion 12. A sleeve measuring 6" wide as flalttened provids an ample opening for freely receiving the pipe and fittings. The overall width of the net body 11' and side sleeves 12 should be about 8' and the overall length of the net body 11' and end sleeve 12 should be from 9', if it is desired to have the net terminate at the lower ends of the angle mid-section 15, 15' as shown in FIGS. 1 to 3, to about 12', if it is desired to have the net extend to the bottom of the frame.

It should be noted in this connection that if intended only, or primarily for punting practice the 9' net length is ample; but when intended primarily for place-kick practice the 12' length is preferable to intercept even a badly topped ball.

Figure 4:
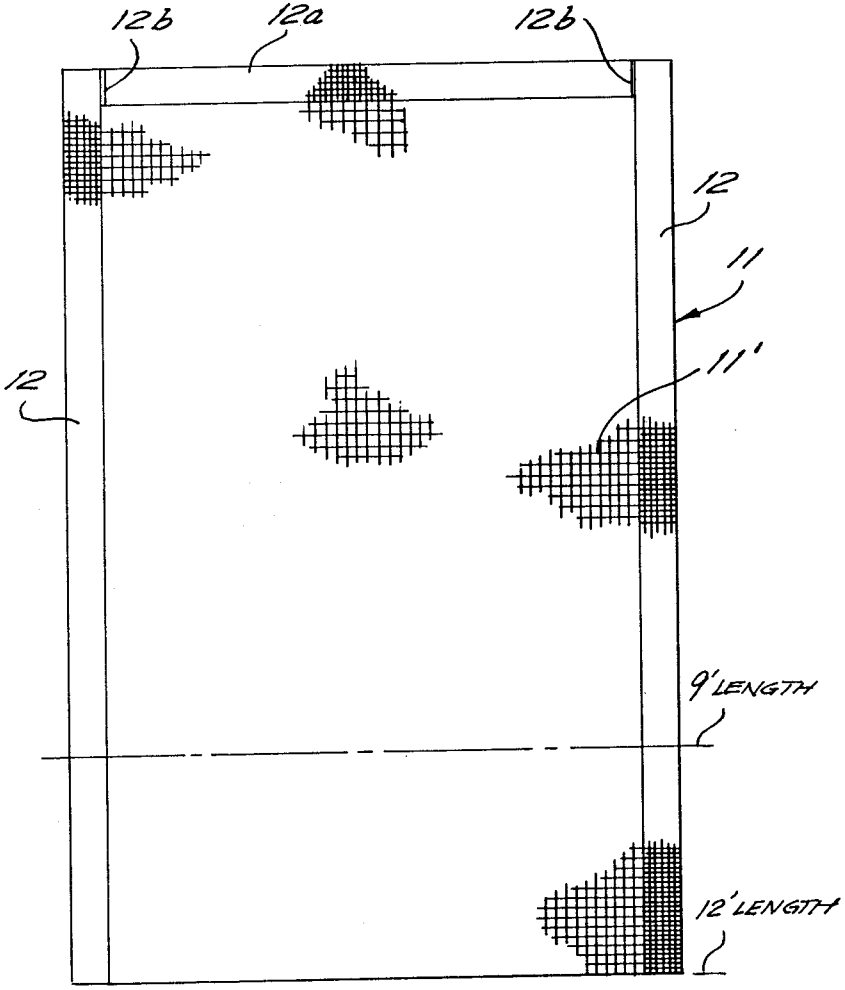
FIG. 4 is an expanded view of the net component of the structure shown in FIG. 1.

As shown in FIG. 4 the transverse sleeve portion **12*a* has slits 12*b* in alignment with inner edges of the side sleeves 12 to facilitate assemblage to the frame. Assemblage can easily be accomplished in various ways. One practical approach is to assemble all frame parts except for the top transverse member 21. Then, with the frame resting on its back, with bottom transverse member 21' and top vertical members 22, 22' touching the ground, slide the full length of the side sleeves 12 onto the frame. Then feed the top transverse member 21 into the transverse sleeve 12*a* while longitudinally compressing the sleeve to fit within the length of member 21. Finally, the ends of member 21 are pressure engaged with the elbows 20, 20' of the front-to-rear top members 19, 19'**.

Now when the frame is raised to its standing position and the net sleeve slid to fully extended portion on the frame, the net 10 will assume substantially and configuration shown in FIG. 1. Note that this configuration is characterized as having a large forwardly and downwardly extending bulge 25 which blends into a deep downwardly extending trough 26 which encompasses most of the front-to-rear dimension of the base. Thus the main weight of the net 11 is suspended in a grossly sagging state providing great shock absorption when contacted by a kicked ball.

When using the kicking practice device an individual practicing punting will stand about 6' in front of the device. From this position most punts will engage the net within the bracketed zone 27 shown in FIG. 1, with the fully arrested ball causing a net distortion of the general type shown in FIG. 2. Realize, however, that every kick will produce a different distorted net configuration, but after each kick the net returns to the general position shown in FIG. 1.

When using the device for place-kick practice an individual will have the ball supported 6' to 8' in front of the device. When kicked from this position the ball will engage the net within the bracketed zone 28 shown in FIG. 1, with the fully arrested ball causing a net distortion of the general type shown in FIG. 3.

While the net is relatively light in weight the sudden upward movement of the bulge 25 and the trough portion 26, when the net is engaged by a kicked ball provides very effective shock-absorbing action, and very little "tilting" force is transmitted to the frame. Yet the net is flexible and heavy enough to quickly return to the FIG. 1 configuration and conveniently discharges the ball at the front of the device, for easy retrieval.

Various changes and modifications in the football kicking practice device herein disclosed may occur to those skilled in the art, and to the extent that such changes and modifications are embraced by the appended claims, it is to be understood that they constitute part of my invention.

I claim:

1. A football kicking practice device comprising a frame structure having two similar frame parts joined by a front top transverse member to be disposed in parallel vertical orientation, said frame parts including horizontal rearwardly extending portions joining vertical downwardly extending portions, in turn joining downwardly inclined portions extending to a point of vertical alignment with the top transverse member, and further joining downwardly extending vertical portions terminating with means at the lower ends for supporting the frame in vertical orientation, and a large rectangular net with a peripheral sleeve along three sides thereof slidably engagable with the frame structure, whereby the net as assembled to the frame hangs in a manner to provide a forwardly and downwardly bulged upper portion, blending with a lower hanging and forwardly inclined trough portion, such net configuration providing a unique shock absorbing action as the net intercepts a kicked football.

2. A football kicking practice device as defined in claim 1, wherein the net is of a size such that the sleeve of the extended net terminates approximately at the juncture of the said inclined and downwardly extending frame portions, adapting the device for primary use in punting practice.

3. A football kicking practice device as defined in claim 1, wherein the net is of a size such that the sleeves of the extended net terminates approximately at ground level, adapting the device equally to punting and place-kick practice.

4. A football kicking practice device as defined in claim 1, wherein the means for supporting the frame in vertical position comprise extensions on said last named downwardly extending frame portions adapted for embedding in the ground.

5. A football kicking practice device as defined in claim 1, wherein the means for supporting the frame in vertical position comprises extensions on said last named downwardly extending frame portions adapted for embedding in the ground, and said two similar frame parts being unitary lengths of piping deformed to provide the contour described.

6. A football kicking practice device as defined in claim 1, wherein the means for supporting the frame in vertical position comprises horizontal frame portions joined to said last named downwardly extending frame portions which are parallel to, and slightly longer than, the first named horizontal portions, which have their free ends joined by a transverse member of the same length as said first named transverse member, said horizontal and transverse members collectively providing an enlarged base for said frame.

7. A football kicking practice device as defined in claim 6, wherein said frame is of knockdown structure fashioned from plastic plumbing materials comprising appropriate lengths of plastic pipe joined together by plastic 90° and 45° elbows, the 45° elbows being at ends of said downwardly inclined frame portions.

8. A football kicking practice device as defined in claim 7, wherein the elbows are fixedly secured to ends of the horizontal and downwardly inclined frame portions to form sub-assembled frame components, and these components are assembled to form the complete frame by forcibly inserting the vertical frame portions and transverse components into appropriate elbow sockets of the sub-assembled components.

9. A football kicking practice device as defined in claim 8, wherein the 45° elows at the lower ends of said downwardly inclined frame portion are of 2" size with bushings to reduce the upper sockets to 1½" size, and all piping and elbows above said bushings are of 1½" size, while all piping and elbows below said bushings are of 2" size, whereby as disassembled, and for compact storage and transport, the upper vertical frame portions and transverse member can be telescopically inserted in the lower vertical frame portions and transverse member.

10. A football kicking practice device as defined in claim 6, wherein the length of the transverse frame members is 3', the lengths of the other frame portions are respectively:

Upper horizontal: 2'6"
Upper vertical: 2'4"
Downwardly inclined: 3'5"
Lower vertical: 2'6"
Lower horizontal: 3'
and the net size, with 6" sleeve, for this size frame is 8' wide and 9' to 12' long.

* * * * *